US006851632B2

(12) United States Patent
Ferrazza et al.

(10) Patent No.: US 6,851,632 B2
(45) Date of Patent: Feb. 8, 2005

(54) HIGH-PRESSURE CLEANING SPRAY NOZZLE

(75) Inventors: Gerald P. Ferrazza, Schaumburg, IL (US); Timothy M. Vock, Carol Stream, IL (US)

(73) Assignee: Spraying Systems Co., Wheaton, IL (US)

( * ) Notice: Subject to any disclaimer, the term of this patent is extended or adjusted under 35 U.S.C. 154(b) by 0 days.

(21) Appl. No.: 10/350,750

(22) Filed: Jan. 24, 2003

(65) Prior Publication Data

US 2004/0144867 A1 Jul. 29, 2004

(51) Int. Cl.[7] ..... B05B 1/00; F04F 5/44; E21B 10/18; F01N 3/10; F01N 7/08

(52) U.S. Cl. ..... 239/590; 222/575; 239/590.5; 239/601

(58) Field of Search ..... 222/575; 239/590, 239/590.5, 597, 599, 601

(56) References Cited

U.S. PATENT DOCUMENTS 2,731,299 A * 1/1956 Bramming ..... 239/590.5
2,956,400 A * 10/1960 Ferri ..... 239/590.5
3,275,248 A * 9/1966 O'Brien ..... 239/487
3,486,700 A * 12/1969 Bristow ..... 239/590.5
3,785,560 A * 1/1974 Hruby, Jr. ..... 239/590.5
4,079,868 A * 3/1978 Moniot ..... 239/590
4,669,669 A * 6/1987 Drechsel ..... 239/590.5
5,110,560 A * 5/1992 Presz et al. ..... 165/160
5,716,006 A * 2/1998 Lott ..... 239/587.4
5,775,446 A * 7/1998 Lott ..... 239/601
5,820,353 A * 10/1998 Beylich et al. ..... 239/590
5,931,392 A * 8/1999 Adams ..... 239/590
6,726,130 B2 * 4/2004 Jaubertie ..... 239/597

* cited by examiner

*Primary Examiner*—Sheldon J Richter
(74) *Attorney, Agent, or Firm*—Leydig, Voit & Mayer, Ltd.

(57) ABSTRACT

A high-pressure liquid spray nozzle having an elongate nozzle body having a longitudinally extending liquid flow passage, which in the illustrated embodiment, is defined in part by a plastic liquid throttling and stabilizing insert. The insert has a liquid flow passage which includes an upstream entry section, a smaller diameter downstream approach section, and an inwardly converging throat section between the upstream and downstream sections. The upstream passageway section has a scalloped cross-sectional configuration which define a plurality of longitudinally extending flutes effective for stabilizing and minimizing turbulence in the high pressure liquid flow stream directed through the nozzle such that a more concentrated, solid liquid flow stream is discharged from the nozzle with increased velocity and surface impact force for enhanced cleaning.

24 Claims, 2 Drawing Sheets

HIGH-PRESSURE CLEANING SPRAY NOZZLE

FIELD OF THE INVENTION

The present invention relates generally to spray nozzles, and more particularly, to spray nozzles for high pressure cleaning applications.

BACKGROUND OF THE INVENTION

Spray nozzles for high pressure cleaning applications direct a high velocity liquid stream against a surface to be cleaned. The liquid stream forcefully impinges against the surface in order to remove dirt or other particles thereon. Such nozzles, for example, are commonly used in pressure washers, car washes, and other cleaning applications. The trend has been to use increasingly higher liquid pressures in order to achieve greater impact forces. However, as the liquid pressure increases, increased turbulence within the spray nozzle and the discharging flow stream can disrupt and break up the concentration of the flow stream, thereby reducing its impact force. The resulting non-uniformity of the broken up stream further can result in inadequate and/or uneven cleaning of a surface. Heretofore it has been difficult to direct a concentrated solid liquid stream at relatively high liquid pressures.

OBJECTS AND SUMMARY OF THE INVENTION

It is an object of the present invention to provide an improved spray nozzle adapted for high pressure cleaning applications.

Another object is to provide a spray nozzle as characterized above which is effective for directing a concentrated high-pressure liquid stream with higher impact cleaning forces.

A further object is to provide a spray nozzle of the above kind in which the discharging liquid flow stream is effective for uniform surface cleaning.

Still another object is to provide a spray nozzle of the foregoing type which has an internal fluid passageway design which reduces liquid turbulence of the liquid at high pressures and directs a concentrated solid liquid flow stream for greater impact.

Yet another object is to provide a spray nozzle of such type which is adapted for economical manufacture.

Other objects and advantages of the invention will become apparent upon reading the following detailed description and upon reference to the drawings, in which:

Figure 1:
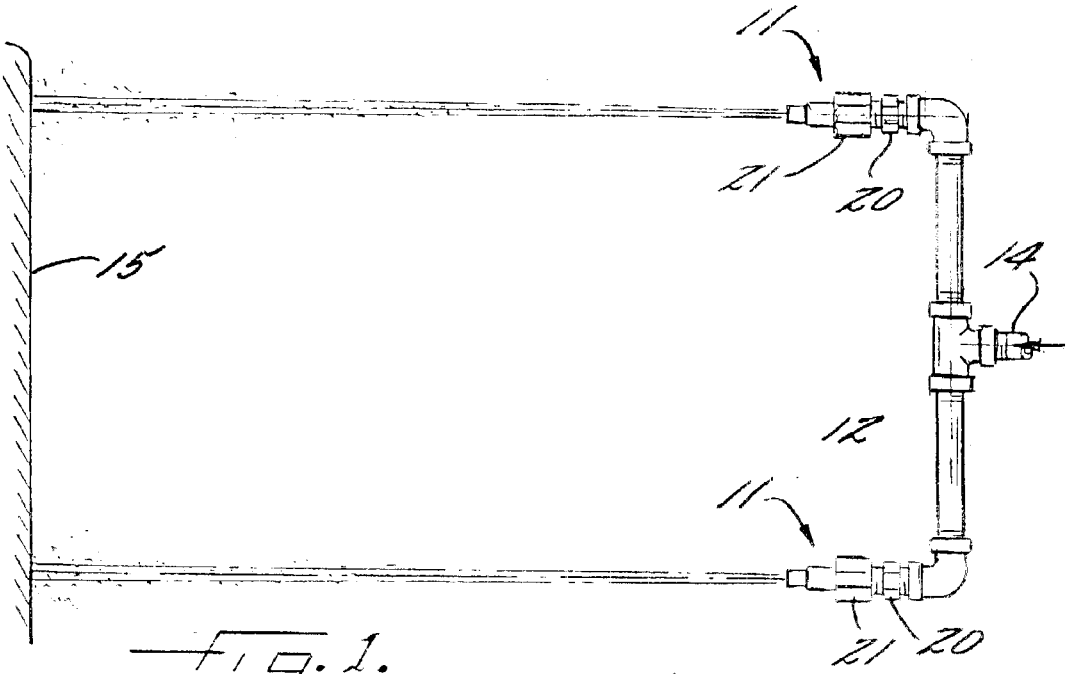
FIG. 1 is a plan view of a spraying apparatus having a plurality of high-pressure liquid spray nozzles in accordance with the invention, each for directing a high-pressure liquid discharge stream against a flat surface to be cleaned.
Figure 2:
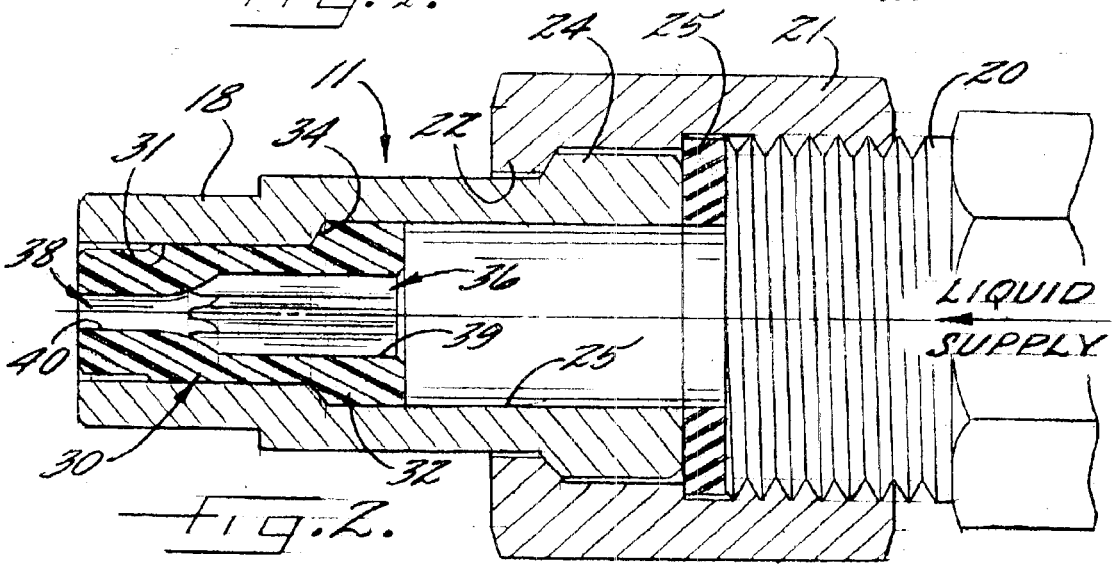
FIG. 2 is an enlarged longitudinal section of one of the spray nozzles shown in FIG. 1.
Figure 3:
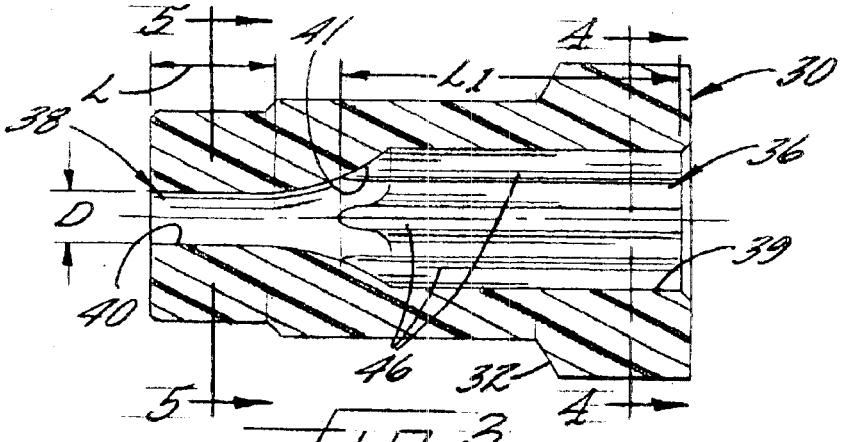
FIG. 3 is an enlarged longitudinal section of a liquid stabilizing insert of the spray nozzle shown in FIG. 2.
Figure 4:
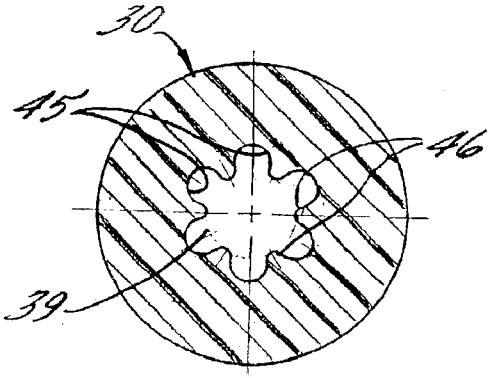
FIGS. 4 and 5 are transverse sections of the liquid stabilizing insert shown in FIG. 2, taken in the planes of line 44 and 5—5, respectively.
Figure 5:
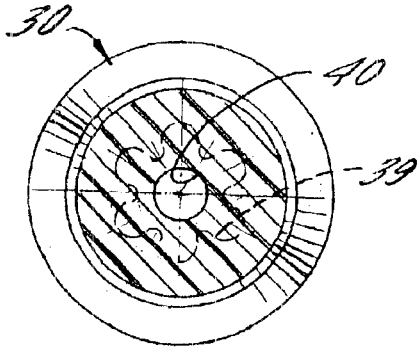

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

Referring now more particularly to FIGS. 1–5 of the drawings, there is shown an illustrative spray apparatus 10 having a plurality of spray nozzles 11 in accordance with the present invention. Spray nozzles 11 in this case are mounted in parallel relation to each other at opposite ends of a header pipe 12, which in turn is coupled through a central supply pipe 14 to a pressurized liquid supply, such as water or other suitable cleaning solutions or fluids. The spray nozzles 11 direct respective high-pressure liquid streams against a surface 15 to be cleaned. Since each of the spray nozzles 1 is identical in construction, only one need to be described in detail.

The illustrated spray nozzle 11 has a nozzle body 18, preferably constructed in one piece of metal or other suitable material for necessary strength. The nozzle body 18 includes an upstream end, which may be connected to a forwardly extended externally threaded end 20 of the header 12 by means of a threaded retaining ring 21. The retaining ring 21 in this case has an annular reduced diameter retaining portion 22 which engages an enlarged diameter annular shoulder 24 of the spray nozzle body 18 and holds it in sealed engagement with a sealing ring 25 interposed between the header end 20 and the spray nozzle 11. In the illustrated embodiment, the nozzle body 18 is substantially cylindrical in form along its longitudinal axis and is formed with a concentric, longitudinal bore 25 extending between its upstream and downstream ends. The upstream end of the bore communicates with the fluid supply header 12.

For stabilizing liquid flow through the nozzle 11, the spray nozzle 11 includes a stabilizing insert 30 fixed in a nozzle body bore 25. The nozzle body bore 25 adjacent a downstream end in this case has a slightly reduced diameter upstream section 31 within which the insert 30 is press fit, with an enlarged annular shoulder 32 of the insert 30 being seated against an angled shoulder 34 defined between the nozzle body bore sections 25, 31.

The liquid stabilizing insert 30 in this case is formed with a concentric, longitudinally extending fluid passageway 36 extending between its upstream and downstream ends. The upstream end of the passageway 36 communicates with the nozzle body bore 25 and the downstream end of the passageway 36 defines a discharge orifice 38 of the spray nozzle. The cross-sectional area of the fluid passageway 36 generally decreases in a downstream direction. More particularly, in the illustrated embodiment, the liquid stabilizing insert passageway 36 includes an upstream or entry passageway section 39 communicating with the nozzle body bore 25, a downstream or approach passageway section 40 communicating with and defining the discharge orifice 38 of the nozzle at its downstream end, and a radiused transition or throat section 41 connecting between the upstream and downstream passageway sections 39,40 The transition or throat section 41 comprises an inwardly rounded or radiused annular shoulder which gradually narrows toward the downstream or approach section 39, and in doing so, presents a controlled transition between the upstream and downstream passageway sections 40, 39. For directing a round liquid discharge stream, the downstream or approach section 40 in this instance has a cylindrical configuration. The approach section 40 preferably has a longitudinal length "L" of at least twice the diameter "D" of the approach passageway section 40.

In accordance with the invention, the stabilizing insert passageway is formed with a plurality of straight axially extending flutes which act to straighten and prevent turbulence of liquid directed through the nozzle such that a more concentrated, solid liquid discharge stream is emitted from the nozzle for higher impact force cleaning. More particularly, the reduced turbulence of the flow stream tends to prevent and minimize undesirable misting and flaring of the discharging liquid, which reduces velocity and uniformity of the flow stream impacting the surface to be cleaned. To this end, in the illustrated embodiment, the entry section 39 of the liquid flow passage 36 has a scalloped cross-sectional configuration formed with a plurality of circumferentially spaced outwardly extended rounded grooves 45 which define a plurality of inwardly extending flutes 46 with rounded inner peripheries. The illustrated flutes 46 extend the entire length L1 of the entry section 39 and partially into the throat section 41 of the nozzle body base 25 within which the stabilizing insert 30 is mounted. The flutes 46 in this case extend about one-third the length of the throat section 41, blending or dying into the throat section in a downstream direction. While the flutes 46 are believed to straighten and stabilize the liquid flow stream as it passes through the inlet section 39, the rounded nature of the flutes 46 and grooves 45 are believed to further minimize the break up and turbulence of the liquid flow stream.

The stabilizing insert 30 preferably is a plastic molded part, which enables economical manufacture of the insert with the intricate, corrugated passageway section 39, 41 and longitudinal flutes 46. The insert 30 has a generally cylindrical outer profile, in this case with stepped or decreasing cylindrical sections, for mounting within the nozzle body bore 25 with a press fit. It will be understood by one skilled in the art that while the fluted stabilizing passageway 36 is defined by a separate insert 30, alternatively, the nozzle may have a one-piece unitary construction, being either a machined or molded part.

In the illustrated embodiment, the entry section 39 of the insert passageway 36 is formed with six rounded grooves 45, which in turn define six flutes 46. The outer perimeters of the grooves 45 define a circle having a diameter at least 2½ times the diameter of the approach section 40, and preferably about 3 times the diameter of the approach section 40. The inner perimeters of the flutes 46 define a circle having a diameter greater than the diameter of the approach section 40. The inwardly extending flutes 46 have a radius which is smaller, in this case about one half, the radius of the grooves 45. The fluted entry section 39 of the liquid passage 36 preferably has a length of at least one half of the length of said insert 12.

In operation of the spray nozzle, it will be seen that pressurized water or other cleaning fluid directed from the supply line into the nozzle body bore 25 will pass through the entry section 39 of the insert passageway 36 with the flutes 46 straightening and stabilizing the liquid along the length of the entry section 36 and into the throat section 41, such that upon passage through the downstream approach passageway section 40 the liquid discharge from the nozzle is a round concentrated flow stream. Since the discharging liquid is free of excessive turbulence and misting, the liquid stream may be directed with increased velocity and impact force against the surface 15 for enhanced cleaning.

Figure 6:
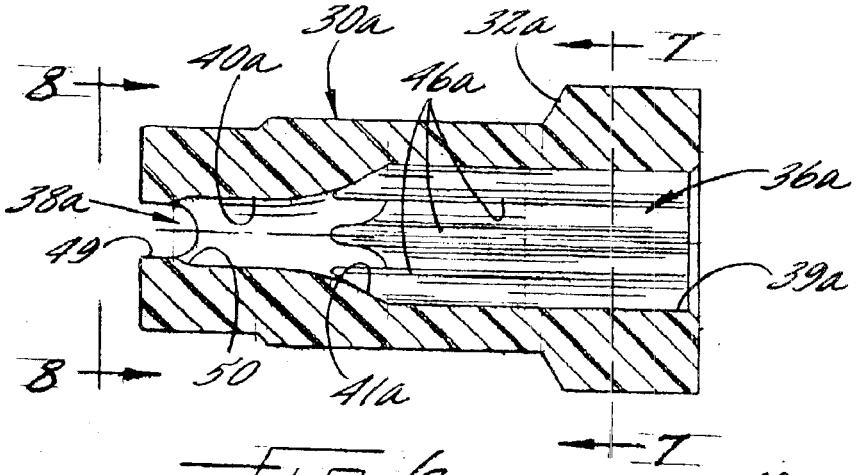
FIG. 6 is a longitudinal section of an alternative embodiment of a liquid-stabilizing insert for use in a high-pressure spray nozzle in accordance with the invention.
Figure 7:
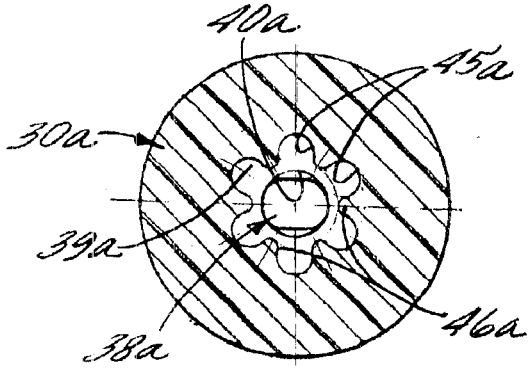
FIG. 7 is a transverse section of the liquid stabilizing insert shown in FIG. 6, taken in the plane of line 7—7.
Figure 8:
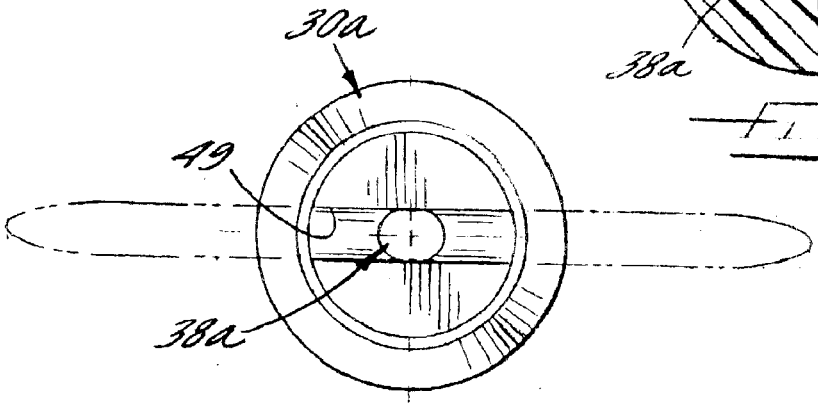
FIG. 8 is an end view of the liquid stabilizing insert shown in FIG. 6, taken in the plane of line 8—8.

Referring FIGS. 6–8 of the drawings, there is shown an alternative embodiment of a liquid stabilizing insert 30*a* in accordance with the invention adapted for directing a flat spray liquid flow stream. Items similar to those described above have been given similar reference numerals with the distinguishing suffix "a" added. The insert 30*a* has a central passageway 36*a* with an upstream or entry section 39*a* and throat or transition section 41*a* similar to that described above.

For directing a flat spray pattern, the insert approach section 40*a* in this case has an oblong cross-sectional configuration, with the long dimension thereof corresponding in diameter to the diameter at the downstream end of the transition passageway section 41*a* As in the previous embodiment, pressurized liquid or cleaning fluid directed through the entry section 39*a* is straightened and stabilized by the longitudinal flutes 36*a*. and accelerated upon passage through the throat section 40*a*. Continued passage of the liquid through the downstream approach section 40*a* flattens the liquid flow stream such that it emits from the discharge orifice 38*a* in a highly concentrated flat spray pattern, again for impacting a surface to be cleaned with enhanced velocity, uniform pressure, and cleaning effectiveness.

The discharge orifice 38*a* in this case is formed by a cross-groove 49 disposed transversely through the downstream end of the insert 30*a*. The groove 49 has a width defined by an upstream circular end which has a diameter slightly less than the diameter of the entry passageway 41*a*. The approach passageway 40 in this case has a rounded downstream portion 50 which is intersected by the cross-groove 49 for providing a smooth transition of liquid from the approach passageway section 40*a* into the discharge orifice 38*a*.

From the foregoing, it can be seen that the spray nozzle of the present invention is adapted for effectively directing a concentrated high-pressure liquid stream with higher impact cleaning forces. Since the discharging liquid stream is in substantially solid form, the cleaning pressure also is relatively uniform. While the liquid stabilizing flow passage of the nozzle has an intricate form, the nozzle nevertheless is adapted for relatively economical construction, with the stabilizing passageway preferably being defined by an inexpensive plastic molded insert.

What is claimed is:

1. A high-pressure spray nozzle comprising:

an elongate nozzle body having an upstream inlet end for coupling to a pressurized liquid supply and a downstream end, said nozzle body defining a longitudinally extending liquid flow passageway between said inlet end and a discharge orifice from which a pressurized liquid flow stream is emitted, said longitudinally extending passageway including an upstream entry section communicating with said inlet end and a downstream approach section communicating with said discharge orifice, said upstream entry section being formed with a plurality of longitudinally extending flutes defined by a plurality of circumferentially spaced outwardly extending grooves for stabilizing and directing a high-pressure liquid passing through the nozzle passageway prior to discharge from said discharge orifice and said plurality of circumferentially spaced grooves defining an outer diameter greater than the diameter of said discharge orifice.

2. The spray nozzle of claim 1 in which said downstream approach passageway section has a smaller cross-sectional flow area than said upstream passageway section.

3. The spray nozzle of claim 2 in which said longitudinally extending passageway includes an inwardly converging throat section between said upstream entry section and said downstream approach section, and said flutes extend from said upstream entry section at least partially into said throat section.

4. The spray nozzle of claim 3 in which an outer perimeter of said grooves define a circle having a diameter at least two and one-half times the diameter of said approach passageway section.

5. The spray nozzle of claim 4 in which an inner periphery of said flutes define a circle having a diameter greater than the diameter of said downstream approach passageway section.

6. The spray nozzle of claim 4 in which said approach section has a length at least twice the diameter of the approach section.

7. A high-pressure spray nozzle comprising:

an elongate nozzle body having an upstream inlet end for coupling to a pressurized liquid supply and a downstream end, said nozzle body defining a longitudinally extending liquid flow passageway between said inlet end and a discharge orifice from which a pressurized liquid flow stream is emitted, said passageway including a liquid stabilizing section formed with a plurality of longitudinally extending flutes for stabilizing and directing a high-pressure liquid passing through the nozzle passageway prior to discharge from said discharge orifice, said flutes defining a plurality of circumferentially spaced flow channels about said liquid flow passageway, and said liquid passageway having no portion upstream of said flutes of a diameter less than the outer diameter of said circumferentially spaced flow channels such that upstream ends of said flow channels communicate freely with the inlet end of said liquid flow passageway without inward radial obstruction in said flow passageway said discharge orifice having a diameter less than said outer diameter of the circumferentially spaced flow channels.

8. The spray nozzle of claim 7 in which said stabilizing passageway section has a scalloped cross-sectional configuration with flutes defined by a plurality of outwardly extending grooves.

9. The spray nozzle of claim 7 in which said flutes are defined by a plurality of circumferentially spaced outwardly extending grooves.

10. The spray nozzle of claim 7 in which an outer periphery of said grooves have a rounded cross-sectional profile.

11. The spray nozzle of claim 10 in which an inner periphery of said flutes each have a rounded cross-sectional profile.

12. The spray nozzle of claim 7 in which said nozzle body is formed with an elongated bore, and said stabilizing passageway section is defined by a separate insert mounted within said nozzle body bore.

13. The spray nozzle of claim 12 in which said nozzle body is made of metal, and said insert is made of molded plastic.

14. A high-pressure spray nozzle comprising:

an elongate nozzle body having an upstream inlet end for coupling to a pressurized liquid supply and a downstream end, said nozzle body defining a longitudinally extending liquid flow passageway between said inlet end and a discharge orifice from which a pressurized liquid flow stream is emitted, said passageway including a liquid stabilizing section formed with a plurality of longitudinally extending flutes for stabilizing and directing a high-pressure liquid passing through the nozzle passageway prior to discharge from said discharge orifice, said flutes defining a plurality of circumferentially spaced flow channel about said liquid flow passageway with outer peripheries of said flutes each having a rounded cross sectional profile and inner peripheries of said flutes each having a rounded cross sectional profile, and said liquid passageway having no portion upstream of said flutes of a diameter less than the outer diameter of said circumferentially spaced flow channels such that upstream ends of said flow channels communicate freely with the inlet end of said liquid flow passageway without inward radial obstruction in said flow passageway.

15. The spray nozzle of claim 14 in which said approach section has a length at least twice the diameter of the approach section.

16. The spray nozzle of claim 14 in which said nozzle body is made of metal, and said insert is made of molded plastic.

17. The spray nozzle of claim 14 in which an outer perimeter of said grooves define a circle having a diameter at least two and one-half times the diameter of said approach passageway section.

18. The spray nozzle of claim 17 in which an inner periphery of said flutes define a circle having a diameter greater than the diameter of said downstream approach passageway section.

19. A high-pressure spray nozzle comprising:

an elongate nozzle body having a longitudinal bore extending between an upstream inlet end for coupling to a pressurized liquid supply and a downstream outlet end, a liquid stabilizing insert mounted within said bore, said insert having a longitudinally extending fluid passageway extending there through having an upstream end in fluid communication with said fluid supply and a downstream end communicating with a discharge orifice, said insert passageway including an upstream entry section communicating with said inlet end and a downstream approach section communicating with said discharge orifice, said downstream approach section having a smaller cross-sectional flow passage area than said upstream inlet section, said insert passageway further including an inwardly converging throat section between said inlet entry section and said downstream approach section, and said upstream entry section being formed with a plurality of longitudinally extending flutes for stabilizing liquid passing through said insert to said discharge orifice.

20. The spray nozzle of claim 19 which said flutes are defined by a plurality of circumferentially spaced outwardly extending grooves.

21. A high-pressure spray nozzle comprising:

an elongate nozzle body having an upstream inlet end for coupling to a pressurized liquid supply and a downstream end, said nozzle body defining a longitudinally extending liquid flow passageway between said inlet end and a discharge orifice from which a pressurized liquid flow stream is emitted, said passageway including a liquid stabilizing section formed with a plurality of longitudinally extending flutes for stabilizing and directing a high-pressure liquid passing through the nozzle passageway prior to discharge from said discharge orifice, said liquid flow passageway having a relatively large diameter section and a relatively small diameter section, said small diameter section having a smaller cross sectional flow area then said relatively large diameter passageway section, said relatively large and small diameter sections communicating with each other through a curved transition section, and said flutes being formed in said relatively large diameter section.

22. The high-pressure spray nozzle of claim 21 in which said flutes extend into said transaction section.

23. A high-pressure spray nozzle comprising:

an elongate nozzle body having an upstream inlet end for coupling to a pressurized liquid supply and a downstream end, said nozzle body defining a longitudinally extending liquid flow passageway between said inlet end and a discharge orifice from which a pressurized liquid flow stream is emitted, said passageway including a liquid stabilizing section formed with a plurality of longitudinally extending flutes for stabilizing and directing a high-pressure liquid passing through the nozzle passageway prior to discharge from said discharge orifice, said liquid flow passage having a first passage section that communicates in a downstream direction with an inwardly converging transition passage section, and said flutes defining a plurality of the circumferentially spaced grooves that communicate with said inlet end and extend into said transition section.

24. A high-pressure nozzle comprising:

an elongate nozzle body having an upstream inlet end for coupling to a pressurized liquid supply and a downstream end, said nozzle body defining a longitudinally extending liquid flow passageway between said inlet end and a discharge orifice from which a pressurized liquid flow stream is emitted, said passageway including a liquid stabilizing section formed with a plurality of longitudinally extending flutes for stabilizing and directing a high-pressure liquid passing through the nozzle passageway prior to discharge from said discharge orifice, said flutes defining a plurality of circumferentially spaced flow channel about said liquid flow passageway, said liquid passageway having no portion upstream of said flutes of a diameter less than the outer diameter of said circumferentially spaced flow channels such that upstream ends of said flow channels communicate freely with the inlet end of said liquid flow passageway without inward radial obstruction in said flow passageway, said liquid flow passage including an approach section in downstream communicating relation to said stabilizing section, and said flutes having an inner peripheries that define a circle having a diameter greater than the diameter of said downstream approach section.

* * * * *